United States Patent [19]

Cresti et al.

[11] 4,251,161

[45] Feb. 17, 1981

[54] CONTROL UNIT FOR A SERIAL PRINTER

[75] Inventors: Marcello Cresti, Strambino; Franco Ugo, Bollengo, both of Italy

[73] Assignee: Ing. C. Olivetti & C., S.p.A., Ivrea, Italy

[21] Appl. No.: 9,502

[22] Filed: Feb. 5, 1979

[30] Foreign Application Priority Data

Feb. 8, 1978 [IT] Italy ..... 67246 A/78

[51] Int. Cl.[3] ..... B41J 1/26

[52] U.S. Cl. ..... 400/144.2; 400/322; 400/903

[58] Field of Search ..... 400/144.2, 144.3, 903, 400/320, 322

[56] References Cited

U.S. PATENT DOCUMENTS

| | | | |
|---|---|---|---|
| 3,908,809 | 9/1975 | Beattie | 400/14.3 |
| 3,954,163 | 5/1976 | Gabor | 400/144.2 |
| 4,044,880 | 8/1977 | Martin | 400/144.3 X |
| 4,091,911 | 5/1978 | Cham et al. | 400/144.2 X |
| 4,101,006 | 7/1978 | Jensen et al. | 400/144.3 |

OTHER PUBLICATIONS

Meier et al., IBM Tech. Discl. Bulletin, vol. 19, No. 1, Jun. 1976, pp. 115–117.

*Primary Examiner*—Edward M. Coven
*Attorney, Agent, or Firm*—Schuyler, Banner, Birch

[57] ABSTRACT

A serial printer comprises a carriage 1 movable along a printing line by a motor MC with a feedback transducer FBC signalling increments of carriage advance. A daisy wheel 2 carries characters to be printed and is rotated by a stepping motor MS with a feedback transducer FBS. In order to maximize printing speed without complex control of the carriage speed a control unit signals when the carriage 1 reaches each printing point in response to feedback pulses from FBC, whether fixed or proportional spacing is used. If the motor MS has by then completed character selection, as determined by counting feedback pulses from FBS, the carriage is not stopped and printing takes place on-the-fly. If character selection has not been completed, the carriage is stopped and printing is effected when character selection is completed.

9 Claims, 4 Drawing Figures

CONTROL UNIT FOR A SERIAL PRINTER

BACKGROUND OF THE INVENTION

The present invention relates to a serial printer of the type having a carriage movable along a printing line and a character-bearing element rotatable on the carriage for selecting the character to be printed at each printing point along the printing line. The character-bearing element may always be stationary at the instant of printing.

A serial printer of this type is that disclosed in U.S. Pat. No. 4,101,006 wherein provision is made for increasing the printing speed by avoiding stopping the carriage at the printing point. The printing is therefore on-the-fly so far as the carriage is concerned, although the character-bearing element is stationary on the carriage. The expression on-the-fly is always used herein in relation to the carriage.

It is necessary that the time taken by the carriage to cover the space between one printing point and the next be sufficient to permit the character-bearing element to position itself at the fresh character; in other words, it is necessary that the time of movement of the carriage be greater than, or equal to, the time of selection of the character.

To this end, the carriage is decelerated from a predetermined speed to a lower speed and then accelerated to the same speed again, before reaching the printing point. It is therefore necessary to have a complex control device capable of generating a family of speed curves for the carriage. Each curve is predetermined as a function of the angle of rotation of the character-bearing element required to select the new character to be printed. A serial printer of this kind has rigid printing characteristics.

The main object of the present invention, therefore, is to achieve an increase in speed in a printer of the type indicated by means of a system which is simpler and has a greater flexibility of application.

The guiding principle is to move the carriage always at the maximum speed possible and to select printing on-the-fly only when the time of selection of the character is less than the time of movement of the carriage. When these conditions are not verified, arrest of the carriage is effected and printing is effected after selection is at an end.

In practice, it is only necessary to determine whether selection has been completed when the carriage reaches the printing point and if so to print on the fly. No consideration has to be given to the carriage speed or the character spacing. The result is that the system can also easily be used when it is desired to vary the space between one print position and the next or it is desired that this space be chosen as a function of the character to be printed. More particularly, the system described hereinafter effects both printing with one or more fixed spacings and spacing proportional to the width of the character to be printed.

When using a stepping motor, the carriage can be moved from one print position to the next by means of a variable number of steps of the motor.

Finally, the invention is easily applied and in particular can be employed both in printers of new design and in existing printers for increasing the printing speed thereof.

A detailed description of a preferred embodiment of the invention will now be given with reference to the accompanying drawings, in which.

The printer comprises a carriage 1, a character-bearing element 2 of the "daisy" wheel type mounted rotatably on the carriage 1, a stepping motor MC for commanding the movement of the carriage 1, a position transducer FBC coupled to the stepping motor MC, a power amplifier AC for generating the command signals for the motor MC, and a driving device STC for the motor MC. The character-bearing element 2 is also actuated by a stepping motor MS which, in turn, is controlled by the devices FBS, AS and STC, which are entirely similar to the devices FBC, AC and STC previously described.

A data source SD sends the characters to be printed to a controller GOV. The controller GOV provides for the processing of the information coming from the data source SD and for passing it on with suitable timing. The source SD may be a data processor, an information transmission line, the buffer of a keyboard or other data source.

An example of a printer of this type is described in our Italian Pat. No. 864395.

The transducer FBC comprises an optoelectronic wheel which emits a signal FC at each step of the motor MC. To each step of the motor there corresponds a movement of the carriage of 0.42 mm (1/60") and, according to whether fixed spacing or variable spacing is used, five or six steps or a number of steps variable between one and seven are used between printing points.

The element 2 bears 100 printing characters. To each step of the motor MS there corresponds an angular movement of 1/200 of a revolution, which generates a pulse FS through the medium of the transducer FBS.

The optoelectronic devices FBS and FBC may be replaced by equivalent devices, for example toothed metal wheels coupled with an inductive circuit which generates a signal on the passage of each tooth.

Figure 4:
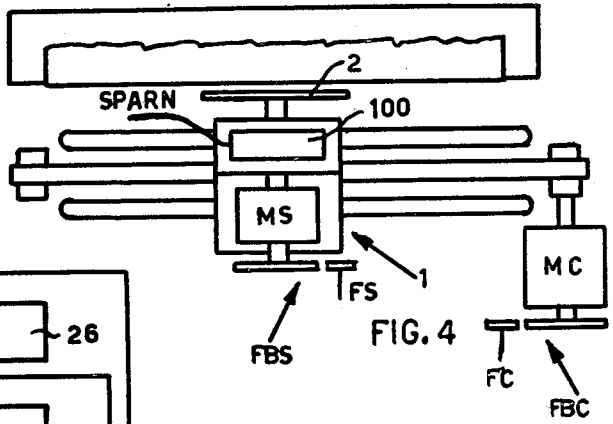
FIG. 4 is a diagrammatic view of the structural parts of the printer of FIG. 1.

The character-bearing element 2, which is represented by a character-bearing disc in FIG. 4, may alternatively be of the spheroidal or cylindrical or other type. The hammer 100 prints the character when selected. The carriage 1 is of the type fast with a toothed belt coupled to the motor MC. The control element STC of the stepping motor may be of any known type and, in particular, may be of the type described in our Italian Pat. No. 1000513.

For clarity, there is tabulated hereunder the correspondence between the signals of the device 1 of Italian Pat. No. 1000513 and the signals of the devices STS and STC used in the present description.

| DEVICE 1 | STC | STS |
|---|---|---|
| OCCU | RIS 2N | RIS 4N |
| PASS | DETRN | DESEN |
| TEF 1 | STAVN | |
| AVIN | RIT | |

-continued

| DEVICE 1 | STC | STS |
|---|---|---|
| MOTO | TRASN | SELEN |
| TEMP | TEO | TEO |
| FEB 1 and 2 | FC | FS |

The present invention is not limited to the combined use of stepping motors and corresponding mechanical transducers. In fact, the stepping motors of the carriage and the daisy wheel may be replaced by direct current motors in which the feedback information on the position actually reached can be detected by a suitable transducer.

Alternatively, stepping motors may be used without position transducers, that is employing an open loop system. In this last case the position reached by the carriage or by the daisy wheel may be detected by utilizing directly the command pulses sent to the respective motors MC and MS within the limits of linear operation of the motors employed.

Figure 1:
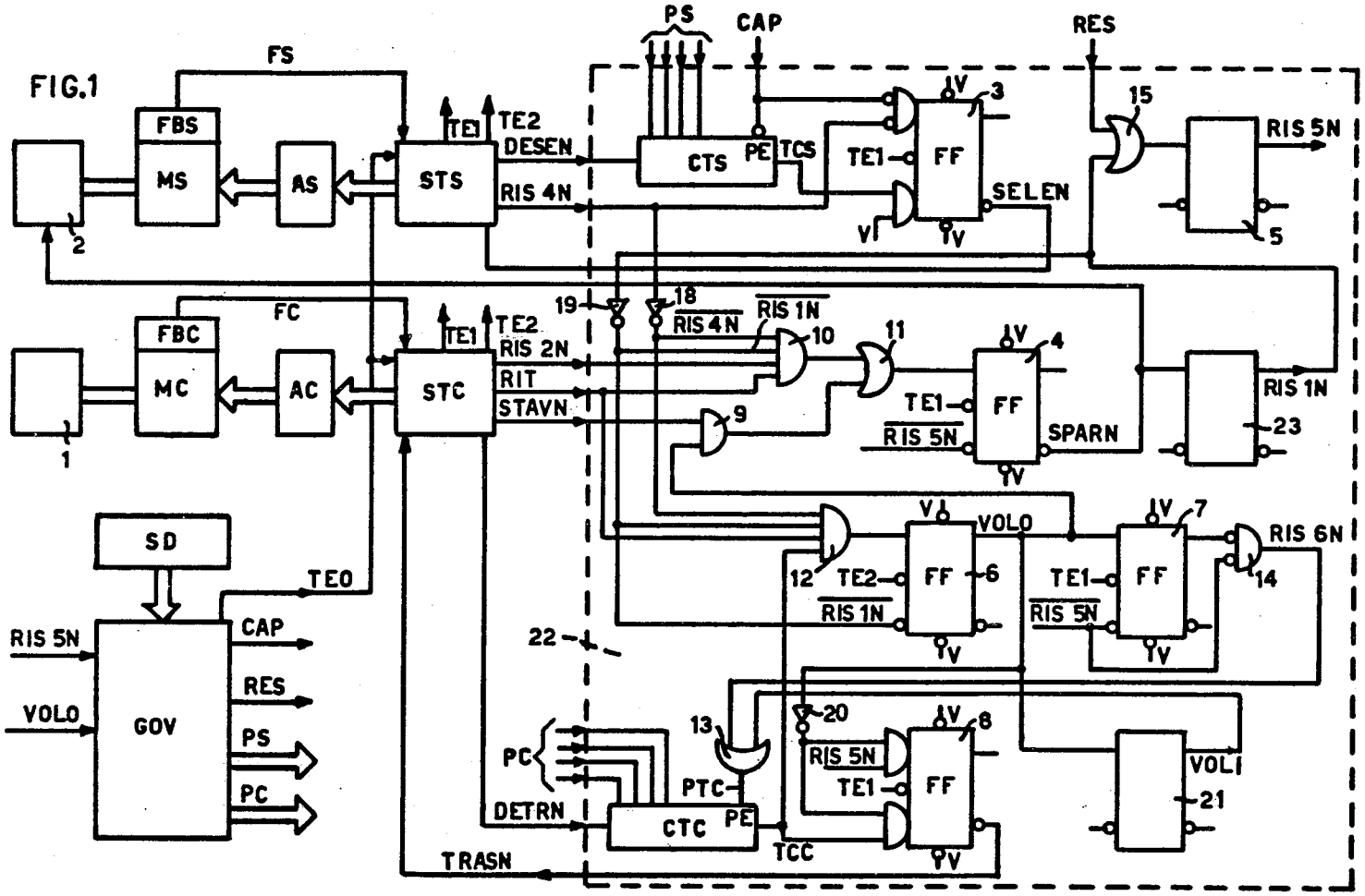
FIG. 1 is a diagram of the printer embodying the invention.

All the remaining devices shown in FIG. 1 form a control unit 22. The control unit 22 comprises two presettable counters CTS and CTC, six flip-flops of the J-K type numbered 3, 4 and 6-8, three monostable circuits 5, 21 and 23, and seven logical gates of the AND, OR and NOR types numbered from 9 to 15.

The description of the working of the arrangement of FIG. 1 will be prefaced by the information that the letter "V" indicates a high and constant logical level and that the signals TE1 and TE2 are suitable synchronising signals generated by the devices STS and STC. The devices STS and STC, in turn, are synchronized by a signal TEO coming from the controller GOV. The main electric signals which are mentioned are given in the timing diagrams of FIG. 2.

The unit GOV receives a succession of characters to be printed from the data source SD and stores them internally. It then initiates printing by sending to the control logic unit the reset signal RES, which prearranges the logic unit for operation. Through the medium of the OR gate 15 and the monostable circuit 5, the control unit generates a signal RIS 5N which is sent to the controller GOV to request a character to be printed. The controller GOV encodes the received from the source SD one at a time and sends two groups of binary signals PC and PS each comprising 4 bits to the logic unit. PS and PC represent the number of elementary rotation steps which the motors MS and MC respectively must effect to print the character sent by the source SD. The controller GOV moreover sends a signal CAP for enabling loading of the counter CTS, while the enabling signal PTC for loading of the counter CTC is generated by the OR gate 13 in response to a signal RIS 6N generated locally by the control unit 22.

Under certain conditions which will be explained hereinafter, the enabling signal CAP and the signal RIS 5N set the flip-flops 3 and 8 respectively, which send signals SELEN and TRASN to low logical level. In turn, the signals SELEN and TRASN command the stepping motor control devices STS and STC, respectively. By means of the amplifiers AS and AC, the control devices STS and STC command the motors MS and MC, which effect in this way the movement of the character-bearing element 2 and of the carriage 1.

At each elementary rotation step of the motors MS and MC, the optoelectronic devices FBS and FBC generate the two feedback signals FS and FC which are sent to the units STS and STC.

At each signal FS and FC received, the units STS and STC generate pulses DESEN and DETRN respectively, which decrement the counters CTS and CTC. If the motors MC and MS are commanded in an open loop arrangement and therefore lack the feedback signals FC and FS, the same command pulses for the motors MC and MS can decrement the counters CTC and CTS.

Figure 2:
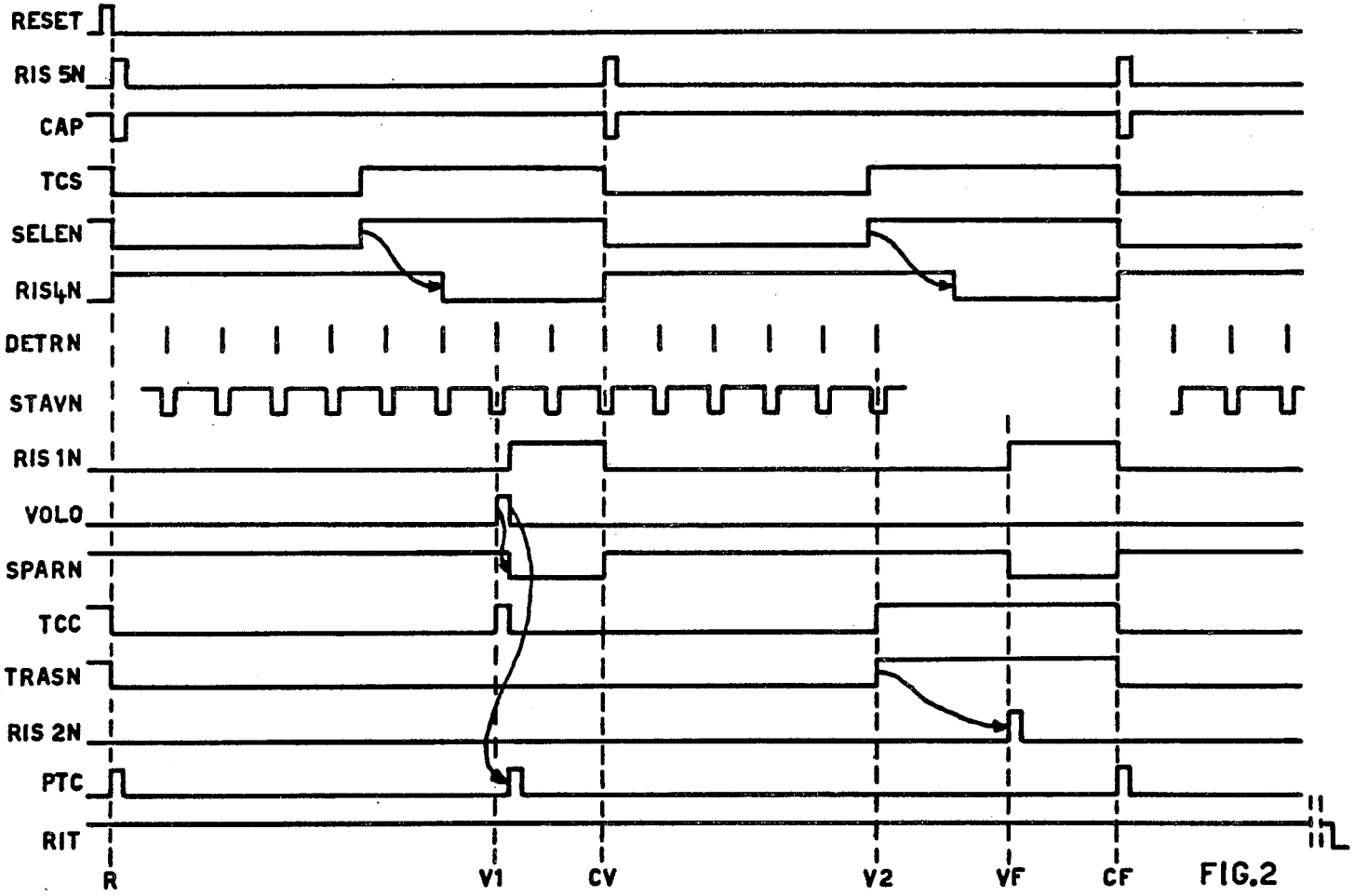
FIG. 2 shows timing diagrams relating to the operation of a control unit.

What has been mentioned so far takes place in correspondence with the instant of reset RES as indicated in FIG. 2 by the dash line R.

During the rotation of the stepping motor MS, the device STS generates a signal RIS 4N, which indicates, with a high logical level, that the selection of the character to be printed is in progress.

During the rotation of the motor MC, the device STC generates a signal STAVN, which is a periodic signal having the same period as the pulses DETRN, and a signal RIT, which remains high until return of the carriage is in progress.

A signal RIS 2N is a pulsed signal which indicates the arrest of the carriage and the times printing from standstill.

When the counter CTS has been cleared, i.e. the present value PS has been counted down to zero, it generates a signal TCS. The signal TCS resets the flip-flop 3, raising the signal SELEN. As a consequence the motor MS stops and, after a certain delay, the device STS resets the signal RIS 4N. The signal RIS 4N signals, with a low logical level, that selection has been completed.

When the counter CTC has been cleared it generates a signal TCC, which is sent as an input to the AND gate 12 together with the signals RIT, $\overline{\text{RIS 1N}}$ from an inverter 19 and $\overline{\text{RIS 4N}}$ from an inverter 18. The output of the AND gate 12 sets the flip-flop 6 at the time indicated by the signal TE2. The synchronism signal TE2 is slightly in advance of the synchronism signal TE1. The signal VOLO generated by the flip-flop 6 is the on-the-fly printing command.

The AND gate 12 sets the flip-flop 6 if and only if the following conditions have occurred: selection has been completed (RIS 4N=0); printing is not in progress (RIS 1N=0); the carriage is not returning to the beginning of a line (RIT=1) and, finally, the fresh printing point has been reached (TCC=1). These conditions are given in the timing diagrams in correspondence with the dash line V1 of FIG. 2.

The signal VOLO produces the following effects: It deactivates the flip-flop 8 by way of an inverter 20, thus inhibiting arrest of the carriage; it generates a signal SPARN which causes on-the-fly printing of the character and, as explained hereinafter, determines the presetting of the counter CTC, thus enabling the motor MC to rotate and the carriage 1 to advance.

The signal SPARN (active low) is generated by the flip-flop 4 at the time indicated by the timing signal TE1, when the output of the OR gate 11 goes high. During on-the-fly printing, the OR gate 11 is activated directly by the output of the AND gate 9, which receives the signals VOLO and STAVN as inputs. The signal SPARN, in addition to representing the print command, sets the monostable circuit 23 by means of its leading edge. The monostable circuit 23 sets the signal RIS 1N at high logical level for the time corresponding to the carrying out of the printing.

In the case of printing on-the-fly, the flip-flop 7 is set by the signal VOLO and reset by the signal RIS 5N and inhibits activation of the signal RIS 6N through the medium of the AND gate 14. In the case of printing from standstill, on the other hand, the flip-flop 7 remains reset and the AND gate 14 remains enabled to pass the signal RIS 5N. The consequence is that in the case of printing on-the-fly the trailing edge of the signal VOLO creates the signal VOLI through the medium of the monstable circuit 21. The signal VOLI presets the counter CTC through the medium of the OR gate 13. In the case of printing from standstill, on the other hand, the counter CTC is preset by the end-of-printing signal RIS 6N through the medium of the OR gate 13.

At the end of on-the-fly printing, the signal RIS 1N is reset, again producing, through the medium of the OR gate 15, the signal RIS 5N, the effect of which on the circuit has already been explained and can be seen in FIG. 2 (dash line CV).

When selection is not completed in correspondence with the end-of-count signal TCC or when some other signal which is being input to the AND gate 12 is not active, the output signal VOLO from the flip-flop 6 is not set. The result is that in the presence of the end-of-count signal TCC, the flip-flop 8 is reset and, through the medium of the signal TRASN, the command for arrest of the carriage is determined. This is possible inasmuch as, the signal VOLO being low, the flip-flop 8 is enabled by the NOT element 20 (see FIG. 2 at the point V2).

The signal SPARN requesting printing is activated in this case by the output of the AND gate 10. The AND gate 10 has the signals $\overline{\text{RIS 1N}}$, $\overline{\text{RIS 4N}}$, RIT and RIS 2N as inputs. That is, printing from standstill is effected when conditions of carriage return do not exist (RIT=1), nor conditions of character selection (RIS 4N=0), nor printing conditions (RIS 1N=0) and the device STC generates the carriage stationary signal RIS 2N.

These conditions can be observed in the timing diagrams of FIG. 2 in correspondence with the dash line VF. As already seen, in the case of printing from standstill, it is the end-of-printing signal RIS 5N which provides for enabling the presetting of the counter CTC and it is also sent to the controller GOV, which provides for the presetting of the counter CTS; the cycle for the printing of a fresh character then begins (FIG. 2, dash line CF).

Figure 3:
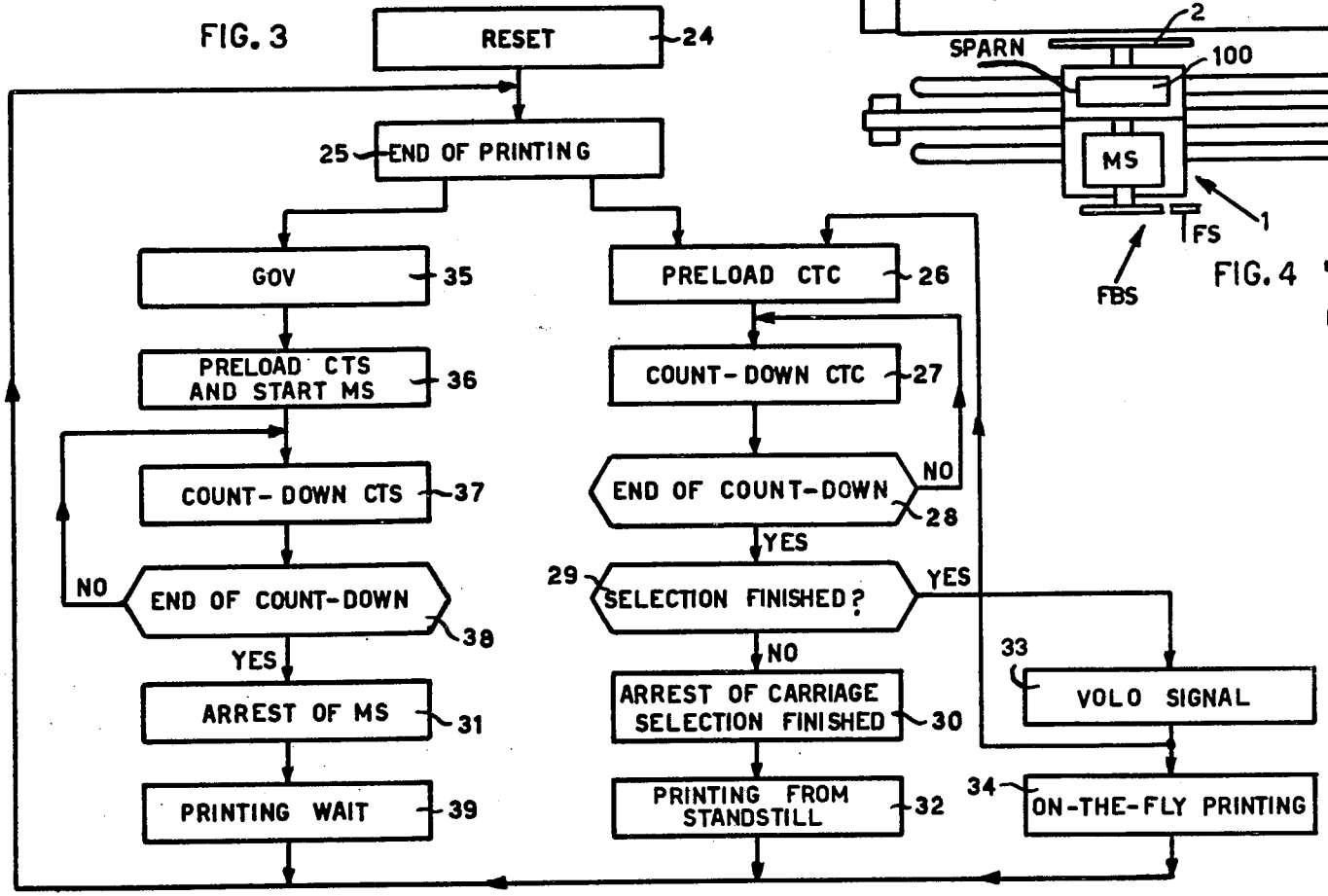
FIG. 3 is a flow diagram of the logical operation of the circuit of FIG. 1.

Let us now briefly summarize the logical sequence of operations by means of the flow diagram of FIG. 3. At the beginning of the printing operations, the controller sends to the control logic unit a reset signal (block 24) which prearranges the circuit for correct operation. The reset signal is interpreted by the circuits of the logic unit 22 as an end-of-printing signal (block 25). The end-of-printing signal has two functions: it directly enables the carriage step counter CTC to be preset (block 26) and is sent in parallel to the controller; the controller, in turn, provides for presetting the character-bearing element step counter CTS by means of the signal CAP (blocks 35 and 36).

The two counters count down independently the steps carried out by the respective mechanical devices until the end-of-count conditions are reached (blocks 27, 28 and 37, 38). At the end of the count-down or clearing of the counter CTS there always follows the arrest of the motor MS (end of selection) and a more or less long printing wait (blocks 31 and 39).

The block 29 checks whether, at the end of the count of the counter CTC arrest of the motor MS has already occurred; this means checking whether at the instant when the carriage is in correspondence with the printing point selection is at an end or not. In the negative case, arrest of the carriage and the finishing of selection take place (block 30) and finally, printing from standstill (block 32). In the positive case, the on-the-fly printing signal VOLO is generated (block 33) and on-the-fly printing is effected (block 34).

The on-the-fly printing signal returns to the beginning of the flow diagram to enable the counter CTC. The carrying out of printing, on the other hand, produces in each case the end-of-printing signal which we have already seen (block 25). Logically, one of the two signals which are input to the block 26 is active according to whether the printing carried out has been from standstill or on-the-fly.

It is clearly apparent from the description how the control unit can increase the speed of a printer of the type indicated without excessive structural complications.

What we claim is:

1. A serial printer comprising a carriage moved by a command unit along a printing line from a preceding print position to a new print position, a print hammer, a type member mounted on the carriage and rotatable intermittently, for positioning a selected character in front of said print hammer for the impact of the selected character on said print position, first sensing means responsive to the angular positions of said type-member for sensing whether a positioning operation of the selected character in front of said hammer has been effected, second sensing means for sensing positions of the carriage proximate to said new print position, and a control unit responsive to said first and second sensing means, for selectivley controlling said command unit and said hammer, wherein said control unit conditions said command unit to arrest said carriage in correspondence with said new print position in response to a not yet effected positioning of the selected character when said proximate position of the carriage is reached, wherein said control unit conditions said command unit to move said carriage through said new print position in response to an already effected positioning operation and wherein said control unit actuates said hammer when both the positioning of the selected character has been effected and said carriage has reached said new position.

2. A serial printer according to claim 1, wherein said second sensing means comprise counting means for counting pulses associated to a plurality of discrete positions of said carriage between said preceding position and said new position signalling the reaching of the proximate position of said carriage.

3. A serial printer according to claim 2, wherein the distance between said preceding and said new print position may be predetermined and selectable or dependent on the sequence and/or width of characters being printed, said first sensing means further comprising means for presetting said counting means, at each new character being printed, with a number corresponding to said distance and wherein said counting means is clocked by said pulses 50 as to produce a terminal count signal to signal to said control unit the reaching of said proximate position.

4. A serial printer according to claim 3, wherein said control unit comprises means responsive to said terminal count signal to condition the command unit to arrest said carriage in case of said not yet effected positioning of the selected character.

5. A serial printer according to claim 1, wherein said control unit comprises means for actuating said hammer at a position of the carriage near to said new position, in the case in which the printing takes place with the carriage in motion.

6. A serial printer according to claim 5, wherein said position near to said new position is said proximate position.

7. A serial printer according to claim 1 wherein said type member is rotated by the rotor of a motor, wherein there is provided a control cirucit for intermittently rotating said rotor through angular steps causing the selected character of the type member to be positioned in front of said hammer and signalling when the selected character is positioned and wherein said first sensing means comprise a counting circuit for counting pulses associated to the angular steps of the rotor.

8. A serial printer according to claim 7 wherein said control circuit presets said counting circuit with a number representative of said angular steps, and is clocked by said pulses so as to produce an end of selection signal in input to said control unit signalling that said positioning operation has been effected.

9. A serial printer according to claim 8, wherein said second sensing means comprise counting means for counting pulses associated to a plurality of discrete positions of said carriage between said preceding position and said new position signalling the reaching of the proximate position of said carriage and means for presetting said counting means, at each new character being printed, with a number corresponding to a distance between said preceding and said new print position and wherein said counting means is clocked by said pulses so as to produce a terminal count signal to signal to said control unit the reaching of said proximate position.

* * * * *